US010676691B2

(12) United States Patent
Little

(10) Patent No.: US 10,676,691 B2
(45) Date of Patent: Jun. 9, 2020

(54) DECORATIVE CANDLE HOLDER WITH DYNAMIC ILLUMINATED IMAGERY

(71) Applicant: Donald Douglas Little, Valley Village, CA (US)

(72) Inventor: Donald Douglas Little, Valley Village, CA (US)

( * ) Notice: Subject to any disclaimer, the term of this patent is extended or adjusted under 35 U.S.C. 154(b) by 79 days.

(21) Appl. No.: 16/134,433

(22) Filed: Sep. 18, 2018

(65) Prior Publication Data

US 2019/0085263 A1 Mar. 21, 2019

Related U.S. Application Data

(60) Provisional application No. 62/559,882, filed on Sep. 18, 2017.

(51) Int. Cl.
*C11C 5/00* (2006.01)
*F21V 35/00* (2006.01)
(Continued)

(52) U.S. Cl.
CPC ..... *C11C 5/004* (2013.01); *C11C 5/008* (2013.01); *F21V 3/04* (2013.01); *F21V 35/00* (2013.01);
(Continued)

(58) Field of Classification Search
CPC ..... C11C 5/004; C11C 5/008; F21V 35/00; F21V 3/04
(Continued)

(56) References Cited

U.S. PATENT DOCUMENTS 598,173 A 8/1897 Henke
3,268,492 A 8/1966 Steinberg
(Continued)

FOREIGN PATENT DOCUMENTS

GB 1471924 4/1977
GB 2220734 1/1990

OTHER PUBLICATIONS

Magic Color Changing Funny Mug (website: https://www.amazon.com/Magic-Color-Changing-Funny- Mug/dp/B01KYGHCXM/ref=pd_lpo_vtph_79_lp_t_3?_encoding=UTF8&psc=1&refRID=VCEVRSGSY2ADPYCD2F6Z 2018.
(Continued)

*Primary Examiner* — Edelmira Bosques
*Assistant Examiner* — Nikhil P Mashruwala
(74) *Attorney, Agent, or Firm* — Michael J. Nickerson; Basch & Nickerson LLP

(57) ABSTRACT

A candle holder comprises a housing for securing a candle; the housing including first thermochromic material formed on the housing and second thermochromic material formed on the thermochromic material. The first thermochromic material changes a perceivable state of the first thermochromic material when an ambient temperature of first thermochromic material is above a first pre-determined activation temperature, the perceivable state of the first thermochromic material being visually perceivable or non-visually perceivable. The second thermochromic material changes a perceivable state of the second thermochromic material when an ambient temperature of second thermochromic material is above a second pre-determined activation temperature, the perceivable state of the second thermochromic material being visually perceivable or non-visually perceivable. The perceivable state of the first thermochromic material is different from the perceivable state of the second thermochromic material.

20 Claims, 4 Drawing Sheets

(51) Int. Cl.

| | |
|---|---|
| ***F21V 3/04*** | (2018.01) |
| ***G09F 19/12*** | (2006.01) |
| ***G09F 13/04*** | (2006.01) |
| *F21W 121/00* | (2006.01) |

(52) U.S. Cl.
CPC ..... *G09F 13/04* (2013.01); *G09F 19/12* (2013.01); *F21W 2121/00* (2013.01)

(58) Field of Classification Search
USPC ..... 431/288
See application file for complete search history.

(56) References Cited

U.S. PATENT DOCUMENTS 4,163,333 A 8/1979 Kwiatkowski
4,334,909 A 6/1982 Chupp
4,818,215 A 4/1989 Taga
4,947,299 A 8/1990 Lin
5,083,251 A 1/1992 Parker
5,605,765 A 2/1997 Rudick
6,165,234 A * 12/2000 Kanakkanatt ..... C10L 5/40 252/1
6,200,129 B1 * 3/2001 Sullivan ..... C11C 5/004 431/126
6,474,980 B2 11/2002 LaVanier
D470,623 S 2/2003 Kwok
6,537,335 B1 * 3/2003 Friars ..... C11C 5/004 431/288
6,654,448 B1 4/2003 Carpenter et al.
6,706,081 B2 3/2004 Mack et al.
6,759,099 B2 7/2004 Lodge
6,808,297 B2 10/2004 Jansen et al.
6,979,120 B1 12/2005 Wolfe
7,011,425 B2 3/2006 Micele, Jr. et al.
7,422,355 B2 9/2008 Hirata
9,062,835 B2 6/2015 White
2001/0031438 A1 * 10/2001 Hannington ..... C11C 5/004 431/288
2001/0043469 A1 * 11/2001 Carpenter ..... B44C 1/10 362/161
2008/0050540 A1 * 2/2008 Christofer ..... B44F 1/06 428/13
2011/0045415 A1 * 2/2011 Shitrit ..... B44F 1/10 431/2
2013/0203002 A1 * 8/2013 Aster ..... F21V 35/003 431/290

OTHER PUBLICATIONS

"The Time for Thermochromics," Materials Today, vol. 11, Issues 11, p. 6, Nov. 2008 Nov. 2008.
"Glowing Photo Luminaries" (website: ourbestbites.com/glowing-photo-luminaries/) downloaded Jul. 16, 2018 2018.
"Thermochromatic Tech Data Sheet" CTI, downloaded Aug. 31, 2017 2017.

* cited by examiner

DECORATIVE CANDLE HOLDER WITH DYNAMIC ILLUMINATED IMAGERY

PRIORITY INFORMATION

The present application claims priority, under 35 U.S.C. § 119(e), from U.S. Provisional Patent Application, Ser. No. 62/559,882, filed on Sep. 18, 2017. The entire content of U.S. Provisional Patent Application, Ser. No. 62/559,882, filed on Sep. 18, 2017, is hereby incorporated by reference.

BACKGROUND

Conventional candle holders provide a base or container for securing a candle. Some conventional candle holders provide merely mechanical functionality, while other conventional candle holders provide decorative functionality in addition to the mechanical functionality.

For example, as illustrated in FIG. 1, a candle holder 10 provides a container for securing a candle 20. The candle holder 10 includes a generally hollow main body and may be opaque or translucent.

The candle 20 is positionable within the hollow section of the main body and can provide, when lit, illumination to the body. It is further noted that the candle 20 may be removable from the candle holder 10.

As illustrated in FIG. 1, imagery 30 is located on the candle holder 10. Imagery 30 may be visually perceptible due to ambient light. Thus, the visual perceptibility of imagery 30 is independent of illumination from the candle 20.

However, as illustrated in FIG. 2, when the candle 20 is lit with a flame 40, the flame 40 provides illumination to the hollow main body of the candle holder and the imagery 30.

The illumination from flame 40 is transmitted through imagery 31 and may interact with imagery 31 to create a brighter or warmer impression of imagery 31.

In this situation, the majority of imagery 31, being visually perceived, is created by light from flame 40 passing through (transmitted) imagery 31, whereas when the candle 20 is not lit, the majority of imagery 30, being visually perceived, is created by light reflecting from imagery 30. The difference between reflected illumination and transmitted illumination may cause a brighter or warmer impression of imagery 31 or other desirable aesthetic characteristics.

Although conventional candle holders provide a mechanism for providing imagery, thereby providing a decorative functionality, the imagery is static in that the actual imagery does not change, but the various aesthetic characteristics can be changed due to the imagery's interaction with the illumination source.

It is desirable to provide a candle holder that provides mechanical functionality for securing a candle in addition to providing decorative functionality, wherein the imagery is dynamic in response to the state of the illumination source.

Moreover, it is desirable to provide a candle holder that provides mechanical functionality for securing a candle in addition to providing decorative functionality, wherein the imagery is changed in response to the state of the illumination source.

Furthermore, it is desirable to provide a candle holder that provides mechanical functionality for securing a candle in addition to providing decorative functionality, wherein the imagery is changed in response to the state of the illumination source, and the aesthetic characteristics of the imagery is changed in response to the state of the illumination source.

In addition, it is desirable to provide a candle holder that provides mechanical functionality for securing a candle in addition to providing decorative functionality, wherein the imagery is dynamic in response to the state of the illumination source, and the aesthetic characteristics of the imagery is dynamic in response to the state of the illumination source.

BRIEF DESCRIPTION OF THE DRAWINGS

The drawings are only for purposes of illustrating various embodiments and are not to be construed as limiting, wherein.

DETAILED DESCRIPTION

Figure 1:
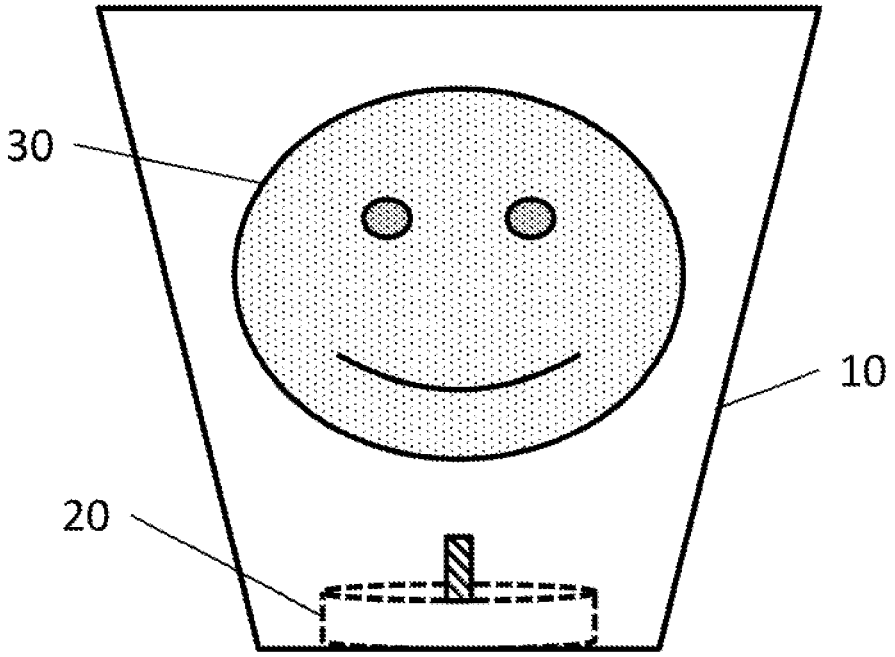
FIG. 1 illustrates an embodiment of an unlit conventional candle holder.
Figure 2:
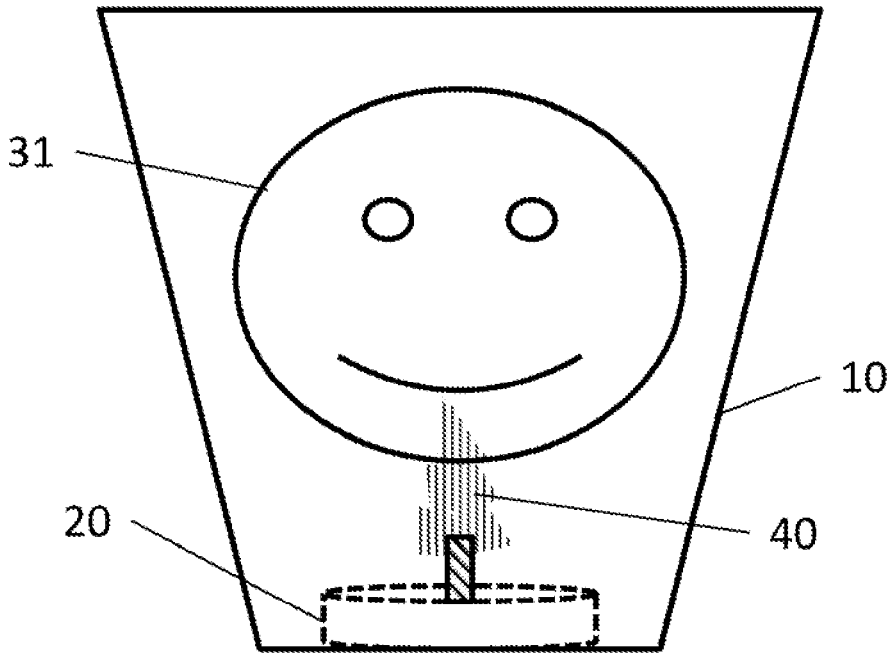
FIG. 2 illustrates the embodiment of FIG. 1 wherein the candle is lit.

For a general understanding, reference is made to the drawings. In the drawings, like references have been used throughout to designate identical or equivalent elements. It is also noted that the drawings may not have been drawn to scale and that certain regions may have been purposely drawn disproportionately so that the features and concepts may be properly illustrated.

Figure 3:
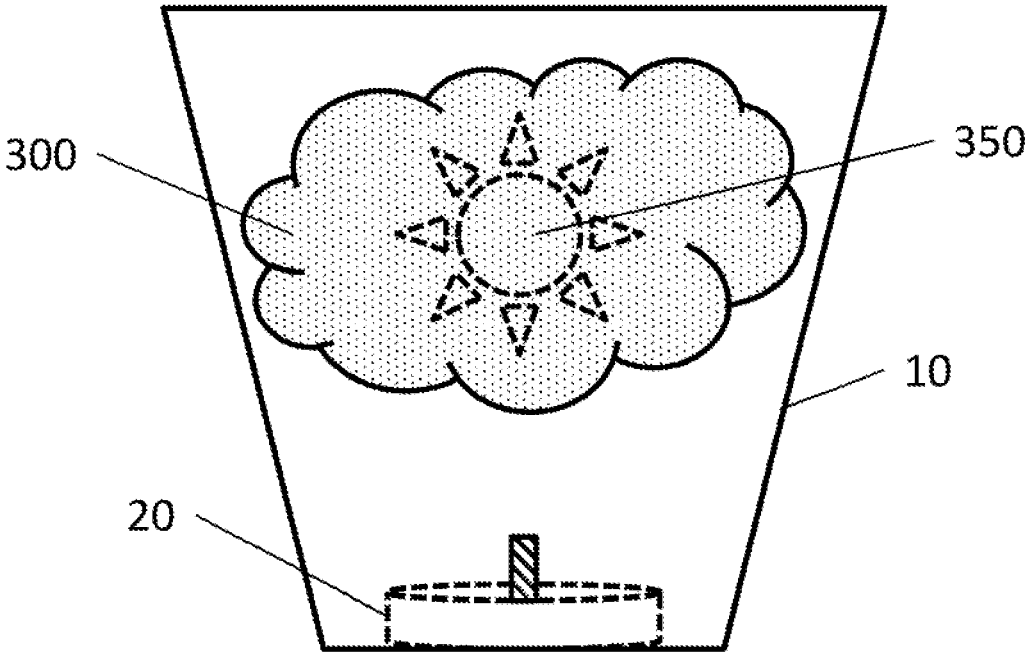
FIG. 3 illustrates an embodiment of an unlit candle holder including imagery that is dynamically responsive to the state of the illumination source.

FIG. 3 illustrates an embodiment of an unlit candle holder 10 including imagery 300 that is dynamically responsive to the state of the candle 20.

As illustrated in FIG. 3, the unlit candle holder 10 also includes imagery 350.

In a first embodiment of the candle holder 10 of FIG. 3, the imagery 350 is not dynamically responsive to the state of the candle 20. In a second embodiment of the candle holder 10 of FIG. 3, imagery 350 is dynamically responsive to the state of the candle 20.

Figure 4:
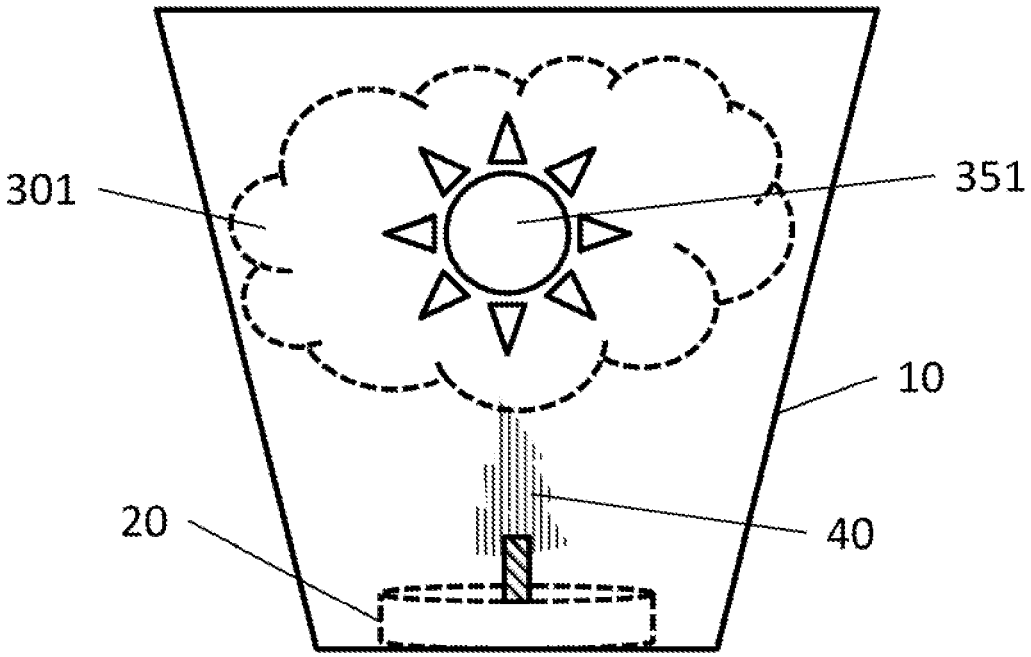
FIG. 4 illustrates the embodiment of FIG. 3 wherein the candle is lit.

With respect to the first embodiment, imagery 350 is created with conventional inks or marking materials that allow illumination to be transmitted therethrough to enable visual perception of imagery 351 (FIG. 4).

On the other hand, the imagery 300 is created with thermochromic inks or marking materials. Imagery 300, as illustrated in FIG. 3, is created over imagery 350 such that imagery 350 is not visually perceptible when the candle 20 is not lit. The imagery 300 is visually perceptible when the temperature of the candle holder 10, the temperature around the imagery 300, is within a first predetermined range.

As illustrated in FIG. 4, when the candle 20 is lit with a flame 40, the imagery 301 is not visually perceptible (becomes clear or "disappears") when the temperature of the candle holder 10 (heated from the flame 40), the temperature around the imagery 301, is outside the first predetermined range.

Alternatively, as not illustrated in FIG. 4, when the candle 20 is lit with a flame 40, the imagery 301 is visually perceptible as a different color when the temperature of the candle holder 10, (heated from the flame 40), the temperature around the imagery 300 is outside the first predetermined range.

Moreover, as illustrated in FIG. 4, when the candle 20 is lit with a flame 40, imagery 351 is visually perceptible because imagery 301 is not visually perceptible (becomes clear or "disappears").

In other words, as illustrated in FIGS. 3 and 4, the visually perceptible imagery is an image of a cloud (FIG. 3); however, when the candle is lit, the visually perceptible imagery is an image of the sun (FIG. 4) because the imagery associated with the image of the cloud becomes clear or "disappears" in response to the temperature of the candle holder, the temperature around the imagery, reaching a value outside the first predetermined range.

In the second embodiment of FIGS. 3 and 4, imagery 350 is created with thermochromic inks or marking materials and created over imagery 300 such that imagery 350 is visually perceptible when the candle 20 is not lit; however, imagery 350 is created with thermochromic inks or marking materials having a color that matches the color of imagery 300 when the temperature of the candle holder 10, the temperature around the imagery 350, is within the first predetermined range.

In the second embodiment of FIGS. 3 and 4, when the candle 20 is lit with a flame 40, imagery 351 changes color so that imagery 351 is distinctly visually perceptible.

More specifically, in the example of the second embodiment of FIGS. 3 and 4, the visually perceptible imagery is an image of a cloud (FIG. 3); however, when the candle is lit, the visually perceptible imagery is an image of the sun in front of a cloud because the imagery associated with the image of the sun changes color to be distinctly visually perceptible, in response to the temperature of the candle holder, the temperature around the imagery, reaching a value outside the first predetermined range.

Figure 5:
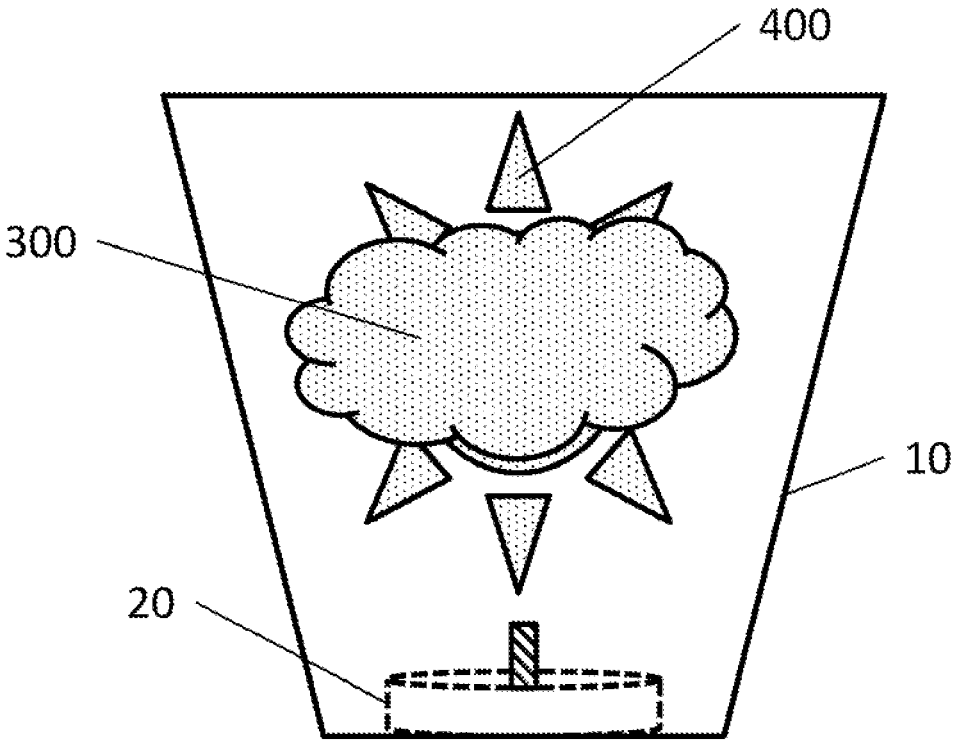
FIG. 5 illustrates another embodiment of an unlit candle holder including imagery that is dynamically responsive to the state of the illumination source.

FIG. 5 illustrates an embodiment of an unlit candle holder 10 including imagery 300 that is dynamically responsive to the state of the candle 20.

As illustrated in FIG. 5, the unlit candle holder 10 also includes imagery 400. The imagery 400 is not dynamically responsive to the state of the candle 20.

With respect to FIG. 5, imagery 400 is created with conventional inks or marking materials that allow illumination to be transmitted therethrough to enable visual perception of imagery 400.

On the other hand, the imagery 300 is created with thermochromic inks or marking materials. Imagery 300, as illustrated in FIG. 5, is created over portions of imagery 400 such that portions of imagery 400 are not visually perceptible when the candle 20 is not lit and portions of imagery 400 are visually perceptible when the candle 20 is not lit.

The imagery 300 is visually perceptible when the temperature of the candle holder 10, the temperature around the imagery 300, is within a first predetermined range.

Figure 6:
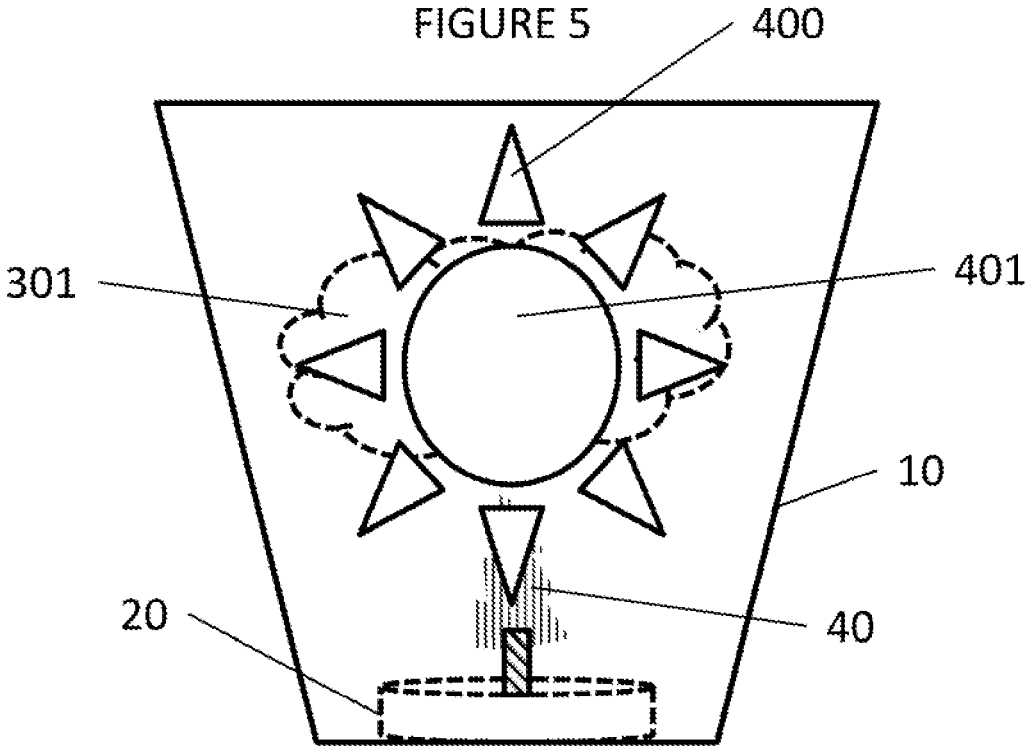
FIG. 6 illustrates the embodiment of FIG. 5 wherein the candle is lit.

As illustrated in FIG. 6, when the candle 20 is lit with a flame 40, the imagery 301 is not visually perceptible (becomes clear or "disappears") when the temperature of the candle holder 10 (heated from the flame 40), the temperature around the imagery 301, is outside the first predetermined range.

Moreover, as illustrated in FIG. 6, when the candle 20 is lit with a flame 40, portions of imagery 401 become visually perceptible because imagery 301 is not visually perceptible (becomes clear or "disappears"). In addition, the portions of imagery 400 remain visually perceptible because these portions of imagery 400 are not covered over with imagery 301.

In other words, as illustrated in FIGS. 5 and 6, the visually perceptible imagery is an image of a cloud partly (mostly) obscuring an image of a sun; however, when the candle is lit, the visually perceptible imagery is an image of the sun without any clouds (FIG. 6) because the imagery associated with the image of the cloud becomes clear or "disappears" in response to the temperature of the candle holder, the temperature around the imagery, reaching a value outside the first predetermined range.

In a second embodiment of FIGS. 5 and 6, portions of imagery 400 are created with thermochromic inks or marking materials and created over imagery 300 such that these portions of imagery 400 are visually perceptible when the candle 20 is not lit; however, these portions of imagery 400 are created with thermochromic inks or marking materials having a color that matches the color of imagery 300 when the temperature of the candle holder 10, the temperature around the imagery 400, is within the first predetermined range.

In the second embodiment of FIGS. 5 and 6, when the candle 20 is lit with a flame 40, imagery 401 changes color so that imagery 401 is distinctly visually perceptible.

More specifically, in the example of the second embodiment of FIGS. 5 and 6, the visually perceptible imagery is an image of a cloud in front of a sun (FIG. 5); however, when the candle is lit, the visually perceptible imagery is an image of the sun in front of a cloud because the imagery associated with the image of the sun changes color to be distinctly visually perceptible, in response to the temperature of the candle holder, the temperature around the imagery, reaching a value outside the first predetermined range.

Figure 7:
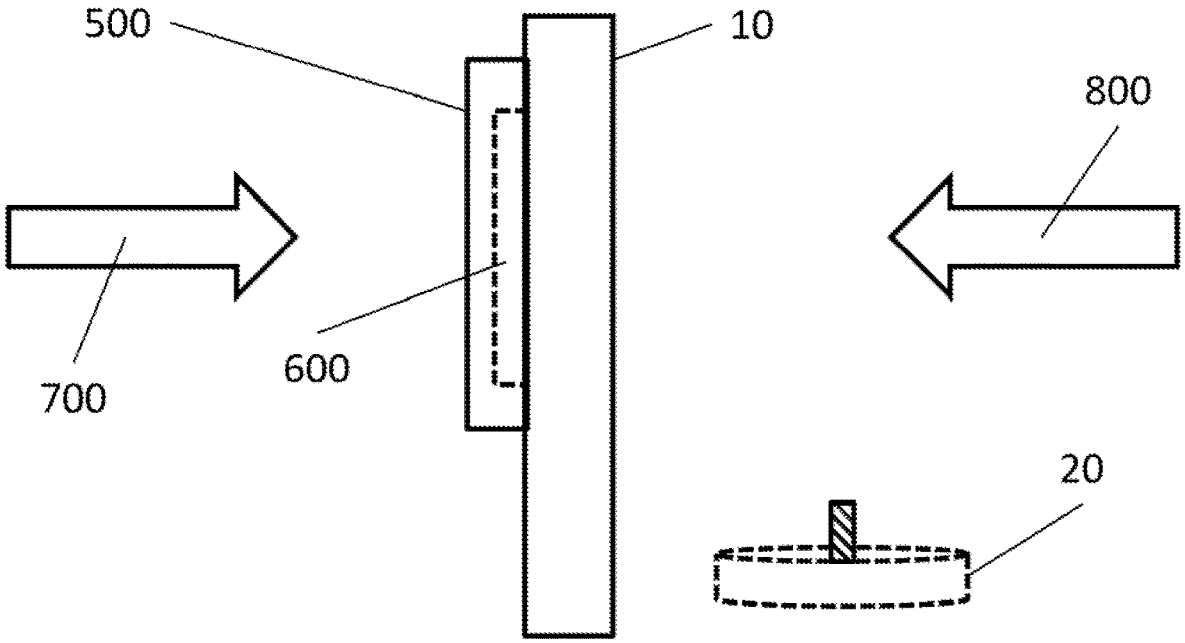
FIG. 7 illustrates an example of the observer's view of an unlit transparent or translucent candle holder including imagery that is dynamically responsive to the state of the illumination source.

FIG. 7 illustrates an embodiment of an unlit transparent or translucent candle holder 10 including imagery 500 that is dynamically responsive to the state of the candle 20 and imagery 600 that is dynamically responsive to the state of the candle 20.

The imagery 500 is formed of thermochromic inks and/or marking materials that change from a color to clear (non-visible to human observer) when the thermochromic inks and/or marking materials are heated (heated from the flame of a candle). The imagery 600 is formed of thermochromic inks and/or marking materials that change from clear (non-visible to human observer) to a color when the thermochromic inks and/or marking materials are heated (heated from the flame of a candle).

The imagery 500 and imagery 600 are formed on a surface of the transparent or translucent candle holder 10, typically on an outer surface of the transparent or translucent candle holder 10. However the imagery 500 and imagery 600 can be formed on an inner surface of the transparent or translucent candle holder 10.

As illustrated in FIG. 7, when a candle 20 within the candle holder 10 is unlit, an observer's view 700 visually perceives imagery 500; however, observer's view 700 fails to visually perceive imagery 600 because imagery 600 is clear (non-visible to human observer) since the ambient temperature around imagery 600 is outside the activation temperature range of the thermochromic inks and/or marking materials forming imagery 600.

Moreover, as illustrated in FIG. 7, when a candle 20 within the candle holder 10 is unlit, an observer's view 800, through the candle holder 10, visually perceives imagery 500; however, observer's view 800 fails to visually perceive, through the candle holder 10, imagery 600 because imagery 600 is clear (non-visible to human observer) since the ambient temperature around imagery 600 is below the activation temperature of the thermochromic inks and/or marking materials forming imagery 600.

Figure 8:
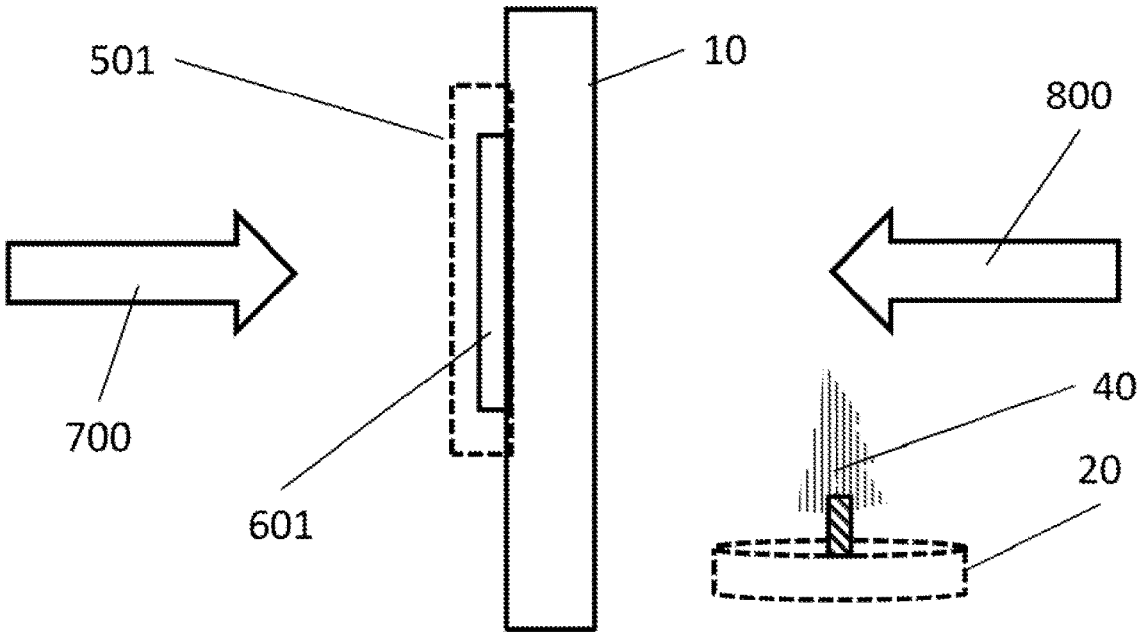
FIG. 8 illustrates the embodiment of FIG. 7 wherein the candle is lit.

As illustrated in FIG. 8, when the candle 20 is lit with a flame 40, imagery 501 is not visually perceptible (becomes clear or "disappears") when the temperature of the candle holder 10 (heated from the flame 40), the temperature around imagery 501, is above the activation temperature of the thermochromic inks and/or marking materials forming imagery 501.

Moreover, as illustrated in FIG. 8, when the candle 20 is lit with a flame 40, imagery 601 become visually perceptible because the temperature of the candle holder 10 (heated from the flame 40), the temperature around imagery 601, is above the activation temperature of the thermochromic inks and/or marking materials forming imagery 601.

In other words, as illustrated in FIG. 8, when the temperature around imagery 501 and imagery 601 is above the activation temperature of the thermochromic inks and/or marking materials forming imagery 501 and imagery 601, non-activated visually perceptible imagery 500 becomes non visually perceptible (clear) 501 and non-activated non-visually perceptible imagery 600 becomes visually perceptible (color) 601.

As illustrated in FIG. 8, when a candle 20 within the candle holder 10 is lit (40), an observer's view 700 fails to visually perceive imagery 501; however, observer's view 700 visually perceives imagery 601 because the ambient temperature around imagery 501 and imagery 601 is above the activation temperature of the thermochromic inks and/or marking materials forming imagery 501 and imagery 601.

Moreover, as illustrated in FIG. 8, when a candle 20 within the candle holder 10 is lit (40), an observer's view 800, through the candle holder 10, fails to visually perceive imagery 501; however, observer's view 800 visually perceives, through the candle holder 10, imagery 601 because the ambient temperature around imagery 501 and imagery 601 is above the activation temperature of the thermochromic inks and/or marking materials forming imagery 501 and imagery 601.

In the various embodiments described above, candle holder includes imagery created by thermochromic inks or marking materials. The thermochromic inks or marking materials may be water based or UV curable.

Moreover, the thermochromic inks or marking materials may disappear (non-visible to human observer) or change color when the thermochromic inks or marking materials are heated (heated from the flame of a candle).

More specifically, the thermochromic inks or marking materials may change from a color to clear (non-visible to human observer) when the thermochromic inks or marking materials are heated (heated from the flame of a candle) and/or the thermochromic inks or marking materials may change from clear (non-visible to human observer) to a color when the thermochromic inks or marking materials are heated (heated from the flame of a candle)

In the various embodiments described above, although the images have been described as distinct images (cloud vs. sun), the images can be of the same subject (circle) but wherein the temperature-responsive imagery causes the color of the circle to change from a first color to a second color as a result of the first color changing to clear or "disappearing" in response to encountering heat.

Alternatively, the temperature-responsive imagery may be that of an egg and the underlying image is that of a developing chick such that the developing chick becomes visually perceptible and the egg "disappears" when the imagery encounters heat.

On the other hand, the temperature-responsive imagery may be that of a clothed person and the underlying image is that of the person only clothed in undergarments such that the person only clothed in undergarments becomes visually perceptible and the outer garments of the person "disappear" when the imagery encounters heat.

In another example as described above, the temperature-responsive imagery may be that of a clothed person and the underlying image is that of the person only clothed in undergarments however the undergarments are not visually perceptible from a backside of the candle holder because the ambient temperature around undergarment imagery is below the activation temperature of the thermochromic inks and/or marking materials forming the undergarment imagery. In this example, the person only clothed in undergarments becomes visually perceptible and the outer garments of the person "disappear" when the imagery encounters heat.

In summary, the various embodiments, described above, provide examples of temperature-responsive imagery, wherein an image changes to another image when a predetermined temperature range is encountered.

It is further noted that the imagery may be created directly upon the candle holder.

Alternatively, the imagery may be created on a transparent or translucent medium or a partially transparent or translucent medium that can be adhered to or attached to the candle holder.

It is noted that the candle holder may be transparent or translucent.

Alternatively, the candle holder may include non-transparent or non-translucent areas and transparent or translucent areas.

It is additionally noted, that although the various embodiments have been described in conjunction with a candle, the candle can be replaced with an illumination source which also produces enough heat to trigger the color change of thermochromic inks or marking materials.

For example, the illumination source may be a battery powered or electric powered device that has a separate illumination source and heat source or a combined illumination/heat source, wherein the heat generated is sufficient to trigger the color change of thermochromic inks or marking materials.

It is noted that the candle may also provide aromatic stimuli when lit.

A candle holder comprises a housing for securing a candle; the housing including first thermochromic material formed on the housing and second thermochromic material formed on the thermochromic material; the first thermochromic material changing a perceivable state of the first thermochromic material when an ambient temperature of first thermochromic material is above a first pre-determined activation temperature, the perceivable state of the first thermochromic material being visually perceivable or non-visually perceivable; the second thermochromic material changing a perceivable state of the second thermochromic material when an ambient temperature of second thermochromic material is above a second pre-determined activation temperature, the perceivable state of the second thermochromic material being visually perceivable or non-visually perceivable; the perceivable state of the first thermochromic material, when the ambient temperature of first thermochromic material is above the first pre-determined activation temperature, being different from the perceivable state of the second thermochromic material when the ambient temperature of second thermochromic material is above the second pre-determined activation temperature; the perceivable state of the first thermochromic material, when the ambient temperature of first thermochromic material is below the first pre-determined activation temperature, being different from the perceivable state of the second thermochromic material when the ambient temperature of second thermochromic material is below the second pre-determined activation temperature.

The perceivable state of the first thermochromic material, when the ambient temperature of first thermochromic material is above the first pre-determined activation temperature, may be non-visually perceivable; the perceivable state of the second thermochromic material, when the ambient temperature of second thermochromic material is above the second pre-determined activation temperature, may be visually perceivable; the perceivable state of the first thermochromic material, when the ambient temperature of first thermochromic material is below the first pre-determined activation temperature, may be visually perceivable; the perceivable state of the second thermochromic material, when the ambient temperature of second thermochromic material is below the second pre-determined activation temperature, may be non-visually perceivable.

The perceivable state of the first thermochromic material, when the ambient temperature of first thermochromic material is above the first pre-determined activation temperature, may be visually perceivable; the perceivable state of the second thermochromic material, when the ambient temperature of second thermochromic material is above the second pre-determined activation temperature, may be non-visually perceivable; the perceivable state of the first thermochromic material, when the ambient temperature of first thermochromic material is below the first pre-determined activation temperature, may be non-visually perceivable; the perceivable state of the second thermochromic material, when the ambient temperature of second thermochromic material is below the second pre-determined activation temperature, may be visually perceivable.

The housing may be transparent. The housing may be translucent. The first thermochromic material may be a thermochromic ink. The second thermochromic material may be a thermochromic ink.

The first pre-determined activation temperature may be substantially equal to the second pre-determined activation temperature. The first pre-determined activation temperature may be different from the second pre-determined activation temperature.

A transferable medium comprises a substrate; first thermochromic material formed on the housing, and second thermochromic material formed on the thermochromic material; the first thermochromic material changing a perceivable state of the first thermochromic material when an ambient temperature of first thermochromic material is above a first pre-determined activation temperature, the perceivable state of the first thermochromic material being visually perceivable or non-visually perceivable; the second thermochromic material changing a perceivable state of the second thermochromic material when an ambient temperature of second thermochromic material is above a second pre-determined activation temperature, the perceivable state of the second thermochromic material being visually perceivable or non-visually perceivable; the perceivable state of the first thermochromic material, when the ambient temperature of first thermochromic material is above the first pre-determined activation temperature, being different from the perceivable state of the second thermochromic material when the ambient temperature of second thermochromic material is above the second pre-determined activation temperature; the perceivable state of the first thermochromic material, when the ambient temperature of first thermochromic material is below the first pre-determined activation temperature, being different from the perceivable state of the second thermochromic material when the ambient temperature of second thermochromic material is below the second pre-determined activation temperature.

The perceivable state of the first thermochromic material, when the ambient temperature of first thermochromic material is above the first pre-determined activation temperature, may be non-visually perceivable; the perceivable state of the second thermochromic material, when the ambient temperature of second thermochromic material is above the second pre-determined activation temperature, may be visually perceivable; the perceivable state of the first thermochromic material, when the ambient temperature of first thermochromic material is below the first pre-determined activation temperature, may be visually perceivable; the perceivable state of the second thermochromic material, when the ambient temperature of second thermochromic material is below the second pre-determined activation temperature, may be non-visually perceivable.

The perceivable state of the first thermochromic material, when the ambient temperature of first thermochromic material is above the first pre-determined activation temperature, may be visually perceivable; the perceivable state of the second thermochromic material, when the ambient temperature of second thermochromic material is above the second pre-determined activation temperature, may be non-visually perceivable; the perceivable state of the first thermochromic material, when the ambient temperature of first thermochromic material is below the first pre-determined activation temperature, may be non-visually perceivable; the perceivable state of the second thermochromic material, when the ambient temperature of second thermochromic material is below the second pre-determined activation temperature, may be visually perceivable.

The substrate may be transparent. The substrate may be translucent. The first thermochromic material may be a thermochromic ink. The second thermochromic material may be a thermochromic ink.

The first pre-determined activation temperature may be substantially equal to the second pre-determined activation temperature. The first pre-determined activation temperature may be different from the second pre-determined activation temperature.

It will be appreciated that several of the above-disclosed embodiments and other features and functions, or alternatives thereof, may be desirably combined into many other different systems or applications. Also, various presently unforeseen or unanticipated alternatives, modifications, variations, or improvements therein may be subsequently made by those skilled in the art which are also intended to be encompassed by the description above.

What is claimed is:

1. A candle holder comprising:

a housing for securing a candle;

a first thermochromic material formed on said housing; and a second thermochromic material formed on said first thermochromic material;

said first thermochromic material changes a perceivable state of said first thermochromic material when an ambient temperature of first thermochromic material is above a first pre-determined activation temperature, said perceivable state of said first thermochromic material being visually perceivable or non-visually perceivable;

said second thermochromic material changes a perceivable state of said second thermochromic material when an ambient temperature of second thermochromic material is above a second pre-determined activation temperature, said perceivable state of said second thermochromic material being visually perceivable or non-visually perceivable;

said perceivable state of said first thermochromic material, when the ambient temperature of first thermochromic material is above said first pre-determined activation temperature, is different from said perceivable state of said second thermochromic material when the ambient temperature of second thermochromic material is above said second pre-determined activation temperature; and said perceivable state of said first thermochromic material, when the ambient temperature of first thermochromic material is below said first pre-determined activation temperature, is different from said perceivable state of said second thermochromic material when the ambient temperature of second thermochromic material is below said second pre-determined activation temperature.

2. The candle holder as claimed in claim 1, wherein said perceivable state of said first thermochromic material, when the ambient temperature of first thermochromic material is above said first pre-determined activation temperature, is non-visually perceivable;

said perceivable state of said second thermochromic material, when the ambient temperature of second thermochromic material is above said second pre-determined activation temperature, is visually perceivable;

said perceivable state of said first thermochromic material, when the ambient temperature of first thermochromic material is below said first pre-determined activation temperature, is visually perceivable;

said perceivable state of said second thermochromic material, when the ambient temperature of second thermochromic material is below said second pre-determined activation temperature, is non-visually perceivable.

3. The candle holder as claimed in claim 1, wherein said perceivable state of said first thermochromic material, when the ambient temperature of first thermochromic material is above said first pre-determined activation temperature, is visually perceivable;

said perceivable state of said second thermochromic material, when the ambient temperature of second thermochromic material is above said second pre-determined activation temperature, is non-visually perceivable;

said perceivable state of said first thermochromic material, when the ambient temperature of first thermochromic material is below said first pre-determined activation temperature, is non-visually perceivable;

said perceivable state of said second thermochromic material, when the ambient temperature of second thermochromic material is below said second pre-determined activation temperature, is visually perceivable.

4. The candle holder as claimed in claim 1, wherein said housing is transparent.

5. The candle holder as claimed in claim 1, wherein said housing is translucent.

6. The candle holder as claimed in claim 1, wherein said first thermochromic material is a thermochromic ink.

7. The candle holder as claimed in claim 1, wherein said second thermochromic material is a thermochromic ink.

8. The candle holder as claimed in claim 6, wherein said second thermochromic material is a thermochromic ink.

9. The candle holder as claimed in claim 1, wherein said first pre-determined activation temperature is substantially equal to said second pre-determined activation temperature.

10. The candle holder as claimed in claim 1, wherein said first pre-determined activation temperature is different from said second pre-determined activation temperature.

11. A transferable medium comprising:

a substrate;

a first thermochromic material formed on said substrate; and a second thermochromic material formed on said first thermochromic material;

said first thermochromic material changes a perceivable state of said first thermochromic material when an ambient temperature of first thermochromic material is above a first pre-determined activation temperature, said perceivable state of said first thermochromic material being visually perceivable or non-visually perceivable;

said second thermochromic material changes a perceivable state of said second thermochromic material when an ambient temperature of second thermochromic material is above a second pre-determined activation temperature, said perceivable state of said second thermochromic material being visually perceivable or non-visually perceivable;

said perceivable state of said first thermochromic material, when the ambient temperature of first thermochromic material is above said first pre-determined activation temperature, is different from said perceivable state of said second thermochromic material when the ambient temperature of second thermochromic material is above said second pre-determined activation temperature; and said perceivable state of said first thermochromic material, when the ambient temperature of first thermochromic material is below said first pre-determined activation temperature, is different from said perceivable state of said second thermochromic material when the ambient temperature of second thermochromic material is below said second pre-determined activation temperature.

12. The transferable medium as claimed in claim 11, wherein said perceivable state of said first thermochromic material, when the ambient temperature of first thermochromic material is above said first pre-determined activation temperature, is non-visually perceivable;

said perceivable state of said second thermochromic material, when the ambient temperature of second thermochromic material is above said second pre-determined activation temperature, is visually perceivable;

said perceivable state of said first thermochromic material, when the ambient temperature of first thermochromic material is below said first pre-determined activation temperature, is visually perceivable;

said perceivable state of said second thermochromic material, when the ambient temperature of second thermochromic material is below said second pre-determined activation temperature, is non-visually perceivable.

13. The transferable medium as claimed in claim 11, wherein said perceivable state of said first thermochromic material, when the ambient temperature of first thermochromic material is above said first pre-determined activation temperature, is visually perceivable;

said perceivable state of said second thermochromic material, when the ambient temperature of second thermochromic material is above said second pre-determined activation temperature, is non-visually perceivable;

said perceivable state of said first thermochromic material, when the ambient temperature of first thermochromic material is below said first pre-determined activation temperature, is non-visually perceivable;

said perceivable state of said second thermochromic material, when the ambient temperature of second thermochromic material is below said second pre-determined activation temperature, is visually perceivable.

14. The transferable medium as claimed in claim 11, wherein said substrate is transparent.

15. The transferable medium as claimed in claim 11, wherein said substrate is translucent.

16. The transferable medium as claimed in claim 11, wherein said first thermochromic material is a thermochromic ink.

17. The transferable medium as claimed in claim 11, wherein said second thermochromic material is a thermochromic ink.

18. The transferable medium as claimed in claim 16, wherein said second thermochromic material is a thermochromic ink.

19. The transferable medium as claimed in claim 11, wherein said first pre-determined activation temperature is substantially equal to said second pre-determined activation temperature.

20. The transferable medium as claimed in claim 11, wherein said first pre-determined activation temperature is different from said second pre-determined activation temperature.

* * * * *